United States Patent [19]

Fujikake

[11] Patent Number: 4,580,021

[45] Date of Patent: Apr. 1, 1986

[54] CIRCUIT BREAKER

[75] Inventor: Akio Fujikake, Saitama, Japan

[73] Assignee: Fuji Electric Co. Ltd., Tokyo, Japan

[21] Appl. No.: 702,685

[22] Filed: Feb. 19, 1985

[30] Foreign Application Priority Data

Feb. 20, 1984 [JP] Japan ..... 59-29862

[51] Int. Cl.[4] ..... H01H 3/00

[52] U.S. Cl. ..... 200/153 G; 200/153 SC

[58] Field of Search ..... 200/153 SC, 153 G, 153 L, 200/153 H, 318

[56] References Cited

U.S. PATENT DOCUMENTS

| | | | |
|---|---|---|---|
| 3,286,067 | 11/1966 | Menickella et al. | 200/153 G |
| 4,219,713 | 8/1980 | Maier et al. | 200/153 G |
| 4,264,796 | 4/1981 | Nelson et al. | 200/153 SC |
| 4,291,209 | 9/1981 | Seidling et al. | 200/153 G |
| 4,324,963 | 4/1982 | Maier et al. | 200/153 G |
| 4,439,653 | 3/1984 | Umino et al. | 200/153 G |

FOREIGN PATENT DOCUMENTS

| | | | |
|---|---|---|---|
| 2097192A | 10/1982 | United Kingdom | 200/153 G |

*Primary Examiner*—Stephen Marcus
*Assistant Examiner*—Linda J. Sholl
*Attorney, Agent, or Firm*—Bruce L. Birchard

[57] ABSTRACT

A circuit breaker comprising a main contact portion and an actuator portion spaced therefrom and intercoupled therewith by a toggle mechanism, the main contact portion including a fixed-contact member and a movable-contact assembly being actuated into and out of closed relationship with the fixed-contact member by the toggle mechanism upon operation of a hand crank to which is attached an actuator shaft which carries a cam, rotation of the cam by the actuator shaft resulting in movement of the toggle mechanism from a folded condition to an extended condition, closing energy being stored simultaneously in a closing spring assembly through the action of a transmission link carried on the actuator shaft and coupled to the closing spring, such transmission link being coupled to a cam follower which carries a drive plate thereon, such drive plate being coupled to the toggle mechanism, such cam follower being limited in its rotation by a locking action, following which rotation of the actuator shaft stores energy in the closing spring assembly for controlled release upon selective activation by the operator, the transmission link rotating less than 180 degrees in going from the energy storing mode to the energy releasing mode, as a result of which only slight spring length changes occur and high mechanical efficiency is realized, along with high immunity from arcing.

6 Claims, 10 Drawing Figures

CIRCUIT BREAKER

BACKGROUND OF THE INVENTION

1. Field Of The Invention

This invention relates to electrical switching gear and, more particularly, to improved electrical circuit breakers with mechanical energy storing ability.

2. Prior Art

Circuit breakers with mechanical energy storage, per se, are not new. However, prior to this invention they suffered from bulkiness and unreliability because of the coupling arrangement between the actuator portion and the movable contact portion. For example, in the prior art devices, if the actuator portion and the movable contact portion were proximate to each other, metal particles, soot and other debris generated during the arcing phenomenon commonly experienced in circuit breakers found in heavy power circuits is deposited on the actuator portion and impairs the operation of the breakers. Additionally, such prior art breakers required great depth in the actuator portion to accommodate the closing spring.

Therefore, it is an object of this invention to provide a circuit breaker which is free of the general problems recited hereinbefore.

It is a further object of this invention to provide a circuit breaker which is relatively compact, is reliable on a long term basis, stores mechanical energy during the closing process and utilizes that stored energy with maximum efficiency.

SUMMARY OF THE INVENTION

According to the present invention circuit breaker is composed of, first, a main contact portion, which includes a fixed-contact member and a movable-contact assembly supported for movement, about an axis, into and out of contact with the fixed contact member.

The main contact assembly is enclosed in a case which has a top partition or plate which supports the actuator portion of the invention. The actuator portion includes a pair of parallel side plates which are secured to the partition at right angles to the axis of the movable-contact assembly.

Supported from the side plates on an axis at right angles thereto but parallel to the axis of the movable-contact assembly, is one end of a toggle mechanism, the other end of that mechanism being connected through an appropriate opening of that partition or top plate of the main contact portion to the movable-contact assembly for moving that assembly into a closed position when the toggle mechanism is in an extended (upright) position and for moving the movable-contact assembly into an open position when the toggle mechanism is folded.

The actuator portion further includes a drive mechanism having an actuator shaft to which a hand crank is attached. The actuator shaft is supported rotatably in the side plates and carries a cam thereon for ringing the toggle mechanism from a folded to an extended (upright) position and for simultaneously storing mechanical energy in a closing spring assembly.

The toggle mechanism has a first toggle link connected at one end to the movable-contact assembly, as described earlier, for rotating it into and out of contact with the fixed-contact member previously described. The toggle mechanism has a second toggle link coupled at its first end to the remaining end of the first toggle link and carrying thereon, integrally therewith, a bearing plate. A toggle lever has one end pivotably coupled to the remaining end of the second toggle link and supported rotatably at its center from the side plates. Its remaining end is finger-shaped end engages the end of a rotatable, 180°-cut pin (cross-sectionally-D-shaped) rotably carried by one of the side plates. In one of the 180° segments of the end of the pin, the finger of the toggle lever is stoped from rotation by the pin. In the other 180° segment the finger may pass the pin.

The toggle lever is urged in a counterclockwise direction (one arm upright) by a tension spring connected between the toggle lever and one of the side plates.

The actuator shaft carries pivotably thereon, between the side plates, as part of the drive mechanism, a transmission link. A closing spring assembly is connected to the transmission link.

A cam follower is supported rotatably from the side plates and is mechanically coupled to the transmission link. The cam follower is held in engagement with the cam and has a prong at one extremity thereof, which prong (as part of the cam follower) moves in a direction opposite to the direction of rotation of the actuator shaft. The cam follower carries, pivotably thereon, a drive plate, the latter having an engagement portion engaging, under urging, the bearing plate of the second toggle link. A second pivotable shaft with a 180°-sectioned or "D-shaped" end, is mounted in one of the side plates for (in one position of its D-shaped end) locking the prong on the cam follower from further rotation while the spring assembly stores mechanical energy which will bring the toggle mechanism to the extended (upright) position and close the main contact when the second pivotable shaft is rotated to permit the prong on the cam follower to pass its D-shaped sectioned end. One rotation of one of the cams by the actuator arm results, by reason of the limited angular motion of its associated cam follower, in the storage of adequate energy in the associated closing spring, to effect, rapidly, the next breaker closing.

By reason of the fact that the transmission links rotate less than 180° in going from the energy-storage to the energy releasing conditions, the spring length varies only slightly between the two conditions and the efficiency of the system and its ease of operation are increased.

Additionally, since the closing spring assembly for each breaker section extends substantially parallel to the associated movable contact assembly, while being controlled remotely therefrom, the movable contact assembly and the actuator therefor can be spaced from each other and the deleterious effects of arcing to the actuator can be prevented.

An additional feature resides in the fact that, since the pivot for the second toggle link and the associated toggle lever coincide and are aligned with the pivot of the related cam follower at the time the toggle mechanism is in the extended (upright) position, no slippage occurs in the force transmission path and high efficiency in the use of the stored energy is realized.

BRIEF DESCRIPTION OF THE DRAWINGS

This invention and its mode of operation can best be understood by the description which follows taken in conjunction with the drawings herein which.

DETAILED DESCRIPTION OF THE PREFERRED EMBODIMENT

Figure 1:
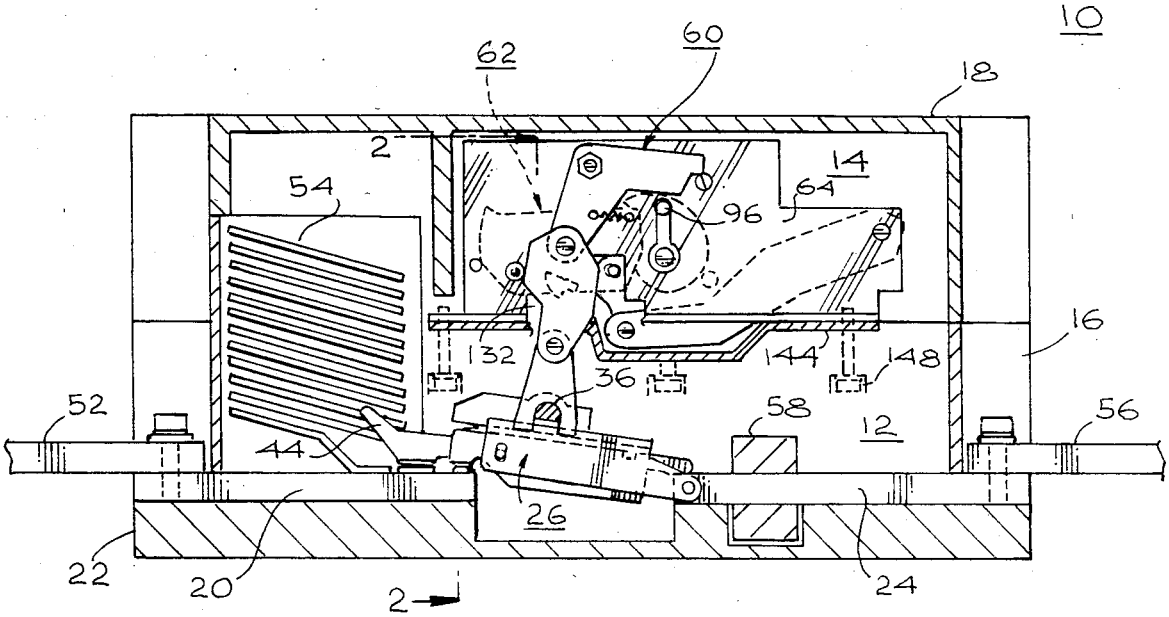
FIG. 1 is a side elevational view, partially sectioned, showing the circuit breaker according to this invention.
Figure 2:
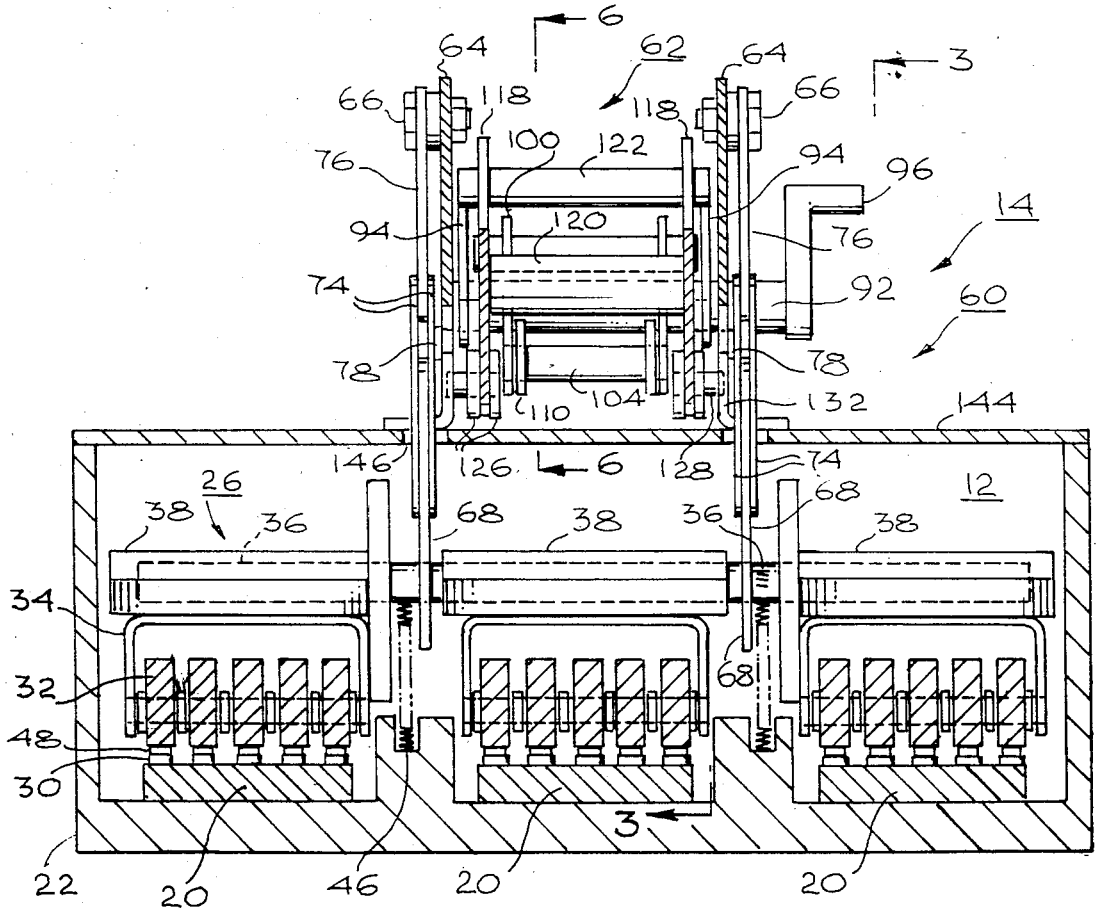
FIG. 2 is an end elevational view, partially sectioned, of the device of FIG. 1.

In FIGS. 1 and 2, circuit breaker 10 includes main contact portion 12 and actuator portion 14 for closing and opening the main contact portion 12, the portions 12, 14 being housed in an insulating case 16 which encloses an insulating cover 18. The main contact portion 12 comprises first fixed contact members 20 mounted on a base 22 of the case 16, second fixed contact members 24 mounted on the base 22, opposite the first fixed contact members 20 and in spaced relation therewith, a movable contact assembly 26 pivotally supported by pins 28 on the respective ends of the second contact members 24 and movable into and out of contact with fixed contacts 30 on ends of the first fixed contact members 20. The movable contact assembly 26 is composed of movable contact members 32 bridging respective pairs of the first and second fixed contact members 20, 24; holders 34 by which the movable contact members 32 are swingably supported and which, in turn, are pivotably supported by the pins 28 on the respective second fixed contact members 24; a crossbar 36 mechanically intercoupling the three poles (FIG. 2) through insulating holders 38 which are integral with the holders 34; contact springs 40, 42 for imposing contact pressure between movable contact members 32 and fixed contact members 20, 24; arc contacts 44 extending from the movable contact members 32; and cutoff springs 46 (FIG. 2) interposed between the crossbar 36 and the base 22 for urging the movable contact assembly 26 in an opening direction. Each of the movable contact members 32 includes a movable contact 48 disposed in opposed relationship to and movable into and out of contact with its respective one of the fixed contacts 30 and an arcuate sliding contact 50 held in sliding contact with one of the second fixed contact members 24. Power source terminals 52 are connected to respective ones of the first fixed contact members 20. The arc contacts 44 are accommodated in an arc-extinguishing chamber 54. Load terminals 56 are connected to respective ones of the second fixed contact members 24, over which an overcurrent detector 58 is positioned, fully transversely thereacross.

The actuator portion 14 is constructed of a toggle mechanism 60 and a drive mechanism 62, and supported by a pair of opposed side plates 64. The toggle mechanism 60 has one end coupled to the crossbar 36 in the main contact device 12 and an opposite end pivotably supported on the side plates 64 by shafts 66, and comprises a pair of spaced first toggle links 58 angularly movably interconnected by pins 70, 72 (FIGS. 3 through 5), two pairs of second toggle links 74 each pair sandwiching one of the first toggle links 68, and a pair of spaced toggle levers 76 sandwiched between respective pairs of the second toggle links 74, on opposite sides of actuator 14. Bearing plates 78 are integral with their respective ones of the inner plates in each of the pairs making up second toggle links 74 and each has on the edge thereof convex surface 80 and concave surface 82. Each of the toggle levers 76 is angularly shaped and has a central portion pivotably supported by the shaft 66 to one of the side plates 64, one end thereof being connected by the pin 72 to the second toggle links 74, and an opposite end having a finger 84 engageable with a cross-sectionally-D-shaped pin 86 rotatably supported in side plate 64. A pair of stops 88 is secured to the side plates 64 parallel to the pins 86 and adjacent the ends of respective toggle levers 76 FIGS. 3 through 5 for limiting counterclockwise motion of the toggle levers 76. A pair of roller stops 89 is secured to the side plates 64 adjacent the second toggle links 74 for limiting angular movement thereof with respect to the first toggle links 68. Tension springs 90 are connected between the toggle levers 76 and the side plates 64 for normally urging the toggle levers 76 in a counterclockwise direction about the shafts 66.

Figure 6:
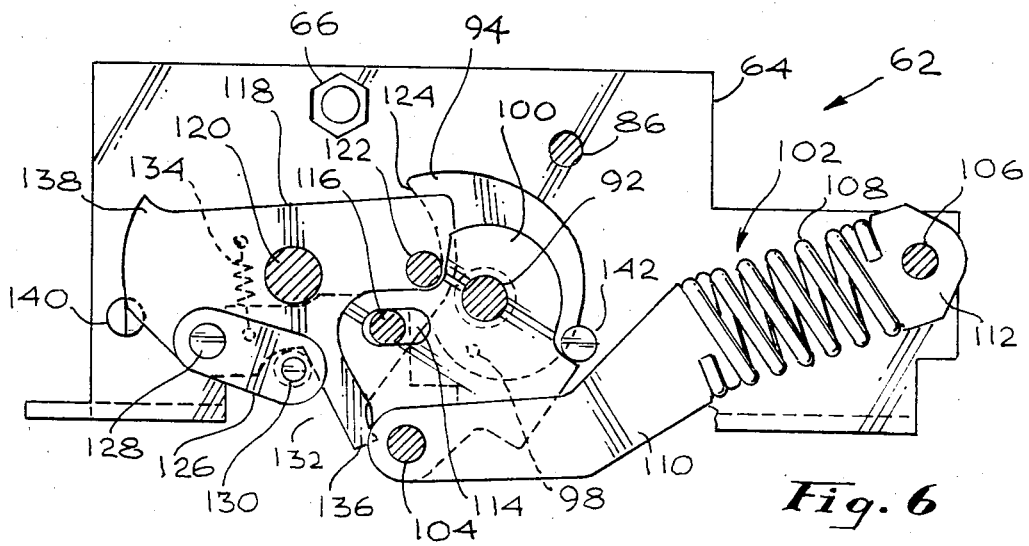
FIG. 6 is a mechanical schematic diagram of a second portion of the device of FIG. 1 in a first condition.
Figure 7:
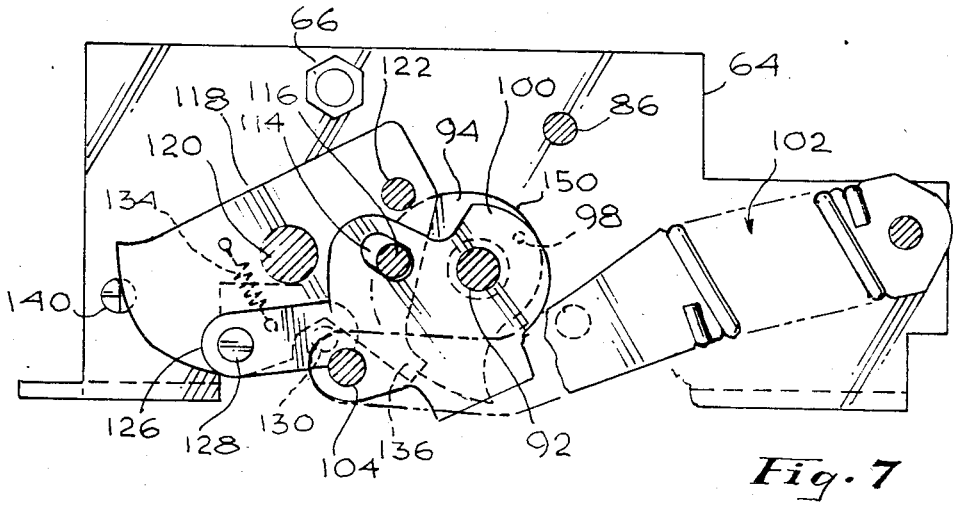
FIG. 7 is a mechanical schematic diagram of that second portion of FIG. 6 in a second condition.
Figure 8:
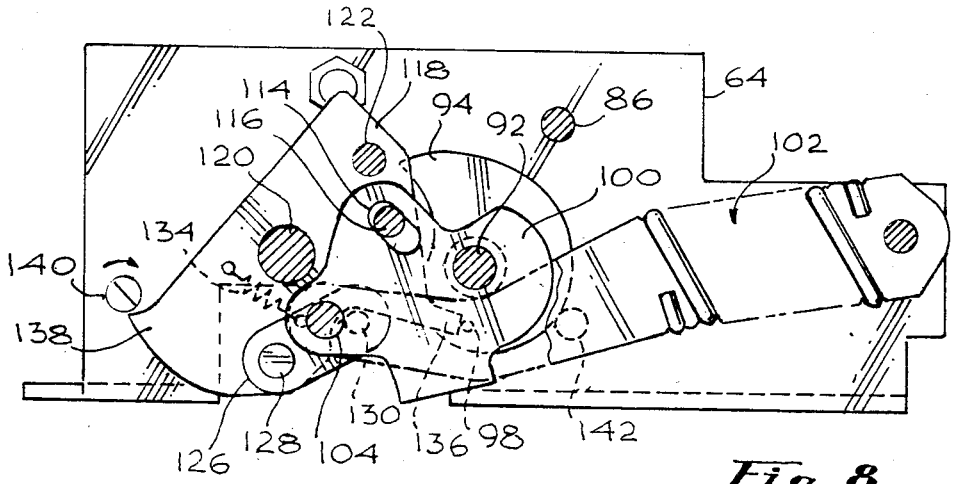
FIG. 8 is a mechanical schematic diagram of that second portion of FIG. 6 in a final condition.

The drive mechanism 62 has most of its components paired in corresponding relationship to the components of the toggle mechanism 60 and supported around an actuator shaft 92 extending through and rotatably supported by the side plates 64. As shown in Figs. 6 through 8, cams 94 are securely fitted on the actuator shaft 92 inwardly of the side plates 64, and an actuating handle 96 is securely fitted over one end of the actuator shaft 92 outwardly of the proximate one of the side plates 64. The cams 94 are rotatable clockwise and have pins 98 mounted on sides thereof. Transmission links 100 are rotatably carried by the actuator shaft 92, with closing spring assemblies 102 connected between the transmission links 100 and the side plates 64 through pins 104, 106. Each of the closing spring assemblies 102 is composed of a tension spring 108 and opposed hooks 110, 112. Each of the transmission links 100 has an oblong hole 114 in which there extends a coupling pin 116 of one of a pair of cam followers 118 pivotably supported by a shaft 120 in the side plates 64. The shaft 120 is positioned so that it is aligned with the pins 72 (FIG. 3) at the time the toggle mechanism 60 is in an upstanding position. Each cam follower 118 has a rotatable roller shaft 122 rollingly movable on an outer peripheral cam surface 124 of the cam 94 for converting clockwise rotation of the cam 94 into counterclockwise rotation of the cam follower 118. Drive plates 126 are rotatably coupled by a pin 128 to each cam follower 118 in sandwiching relationship thereto, the drive plates 126 pivotally supporting a drive pin 130 on their ends remote from the pin 128. The drive pin 130 extends through a hole 132 defined in the side plate 64 and is engageable with the convex and concave surfaces 80, 82, respectively, of the bearing plate 78 of the toggle mechanism 60, which bearing plate is located outwardly from side plate 64 (FIG. 2). Drive plates 126 are urged by a tension spring 134 to turn counterclockwise about the pin 128. The cam follower 118 has a projection 136 disposed to serve as a stop against which the pin 98 of the cam 94 bears when rotation of the cam 94 is completed, and an opposite prong 138 which will be engaged by the cross-sectionally-D-shaped shaft 140 immediately prior to the completion of rotation of the cam 94. The shaft 140 is rotatably supported by the side plates 64, which have stops 142 for limiting counterclockwise angular movement of the transmission links 100. Between the contact portion 12 and the actuator portion 14, there is disposed a partition 144 (FIGS. 1 and 2). The partition 144 has openings 146 through which the toggle mechanism 60 operates. The side plates 64 are fixed to the partition 144 which, in turn, is secured to the case 16 by screws 148.

Operation of the circuit breaker thus constructed will be desribed hereinafter. Operation of the actuator portion 14 is illustrated in FIGS. 3 through 8. FIG. 6 shows the drive mechanism 62 at the time the closing spring assembly 102 starts storing energy. As the actuating handle 96 turns clockwise, the actuator shaft 92 and the cams 94 rotate in the same clockwise direction. The rotation of the cams 94 causes the roller shafts 122 to move along the cam surfaces 150, (FIG. 7), thereby rotating the cam followers 118 counterclockwise. At this time, the transmission links 100 are caused by the coupling pins 116 to rotate clockwise about the actuator shaft 92, thus extending the closing spring assemblies 102 connected to the transmission links 100 to store energy in each closing spring assembly 102. Fig. 7 illustrates the cam 94 in the process of rotation. Before the top of the cam surface 150 of the cam 94 reaches the roller shaft 122, prong 138 of cam follower 118 is engaged by shaft 140. After the top of the cam surface 150 has moved past the roller shaft 122, the pin 98 is held against the projection 136 as shown in FIG. 8, whereupon the actuating handle 96 is prevented from further rotation and energy storage in the closing spring assemblies 102 is completed.

Figure 3:
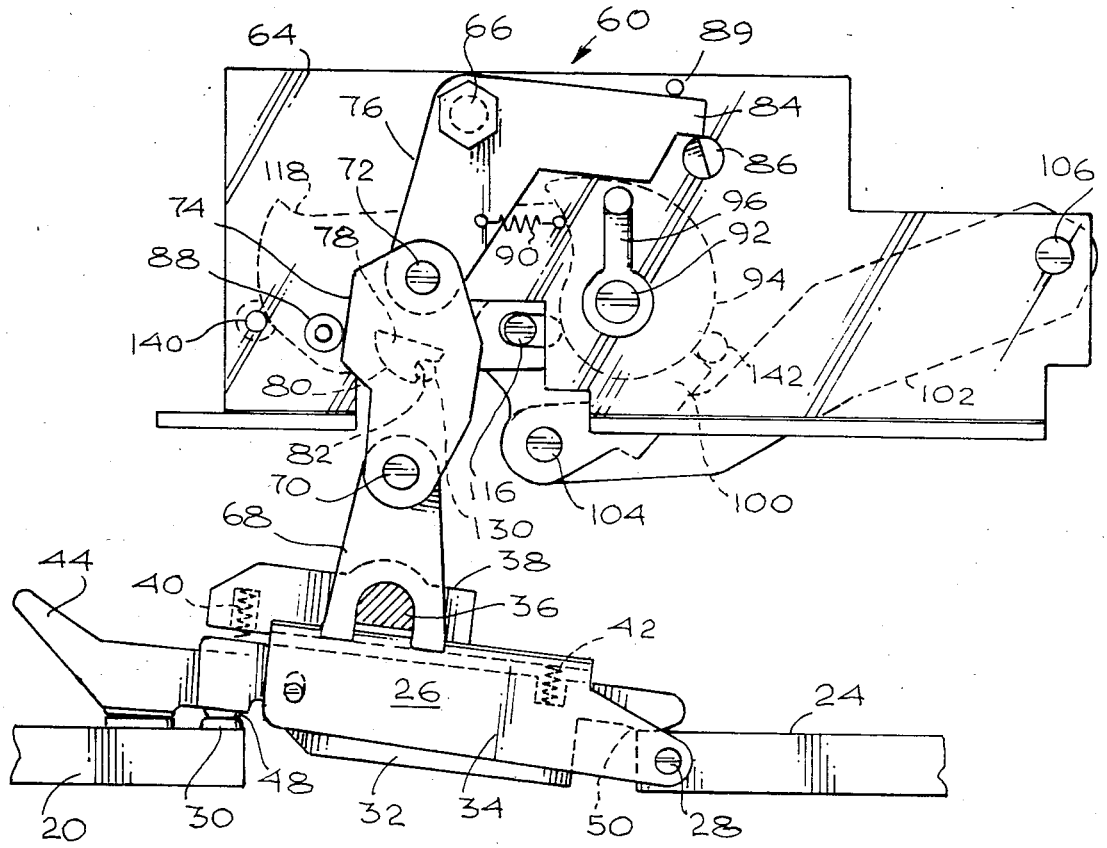
FIG. 3 is a mechanical schematic diagram of a first portion of the device of FIG. 1 in a first condition.
Figure 5:
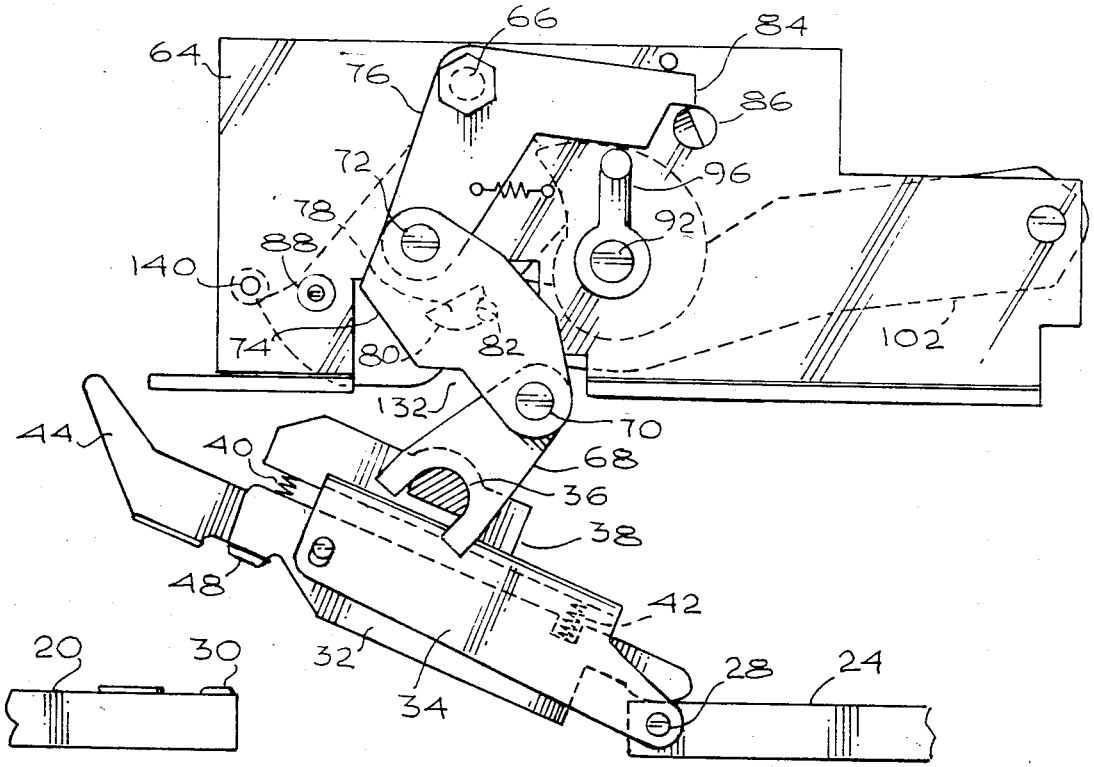
FIG. 5 is a mechanical schematic diagram of that portion of FIG. 3 in a final condition.

The main contact device 12 is closed and opened in response to the operation of the toggle mechanism 60. When the actuator device 14 is in an energy storing condition (while the main contact device 12 is open as shown in FIG. 5), the drive pin 130 is prevented from moving by engagement with the concave surface 82 of the bearing plate 78. As shown in FIG. 8, when the shaft 140 is turned clockwise, the prong 138 disengages shaft 140 and allows the cam follower 118 to be rotated by the closing spring assembly 102. As a result, the second toggle link 74 is rotated clockwise about the pin 72 to bring the movable contact members 32 into contact with the first fixed contact members 20. Thereafter, as shown in FIGS. 3 and 6, the second toggle link 74 abuts the roller stop 88, whereupon the toggle mechanism 60 is in the upstanding position. Simultaneously, the transmission link 100 engages stop 142, thus completing the closing operation of the main contact device 12. At this time, the toggle lever 76 is biased to turn clockwise under the resiliency of the contact spring 40 and the cutoff springs 46 with the finger 84 engaged by the pin 86.

Figure 4:
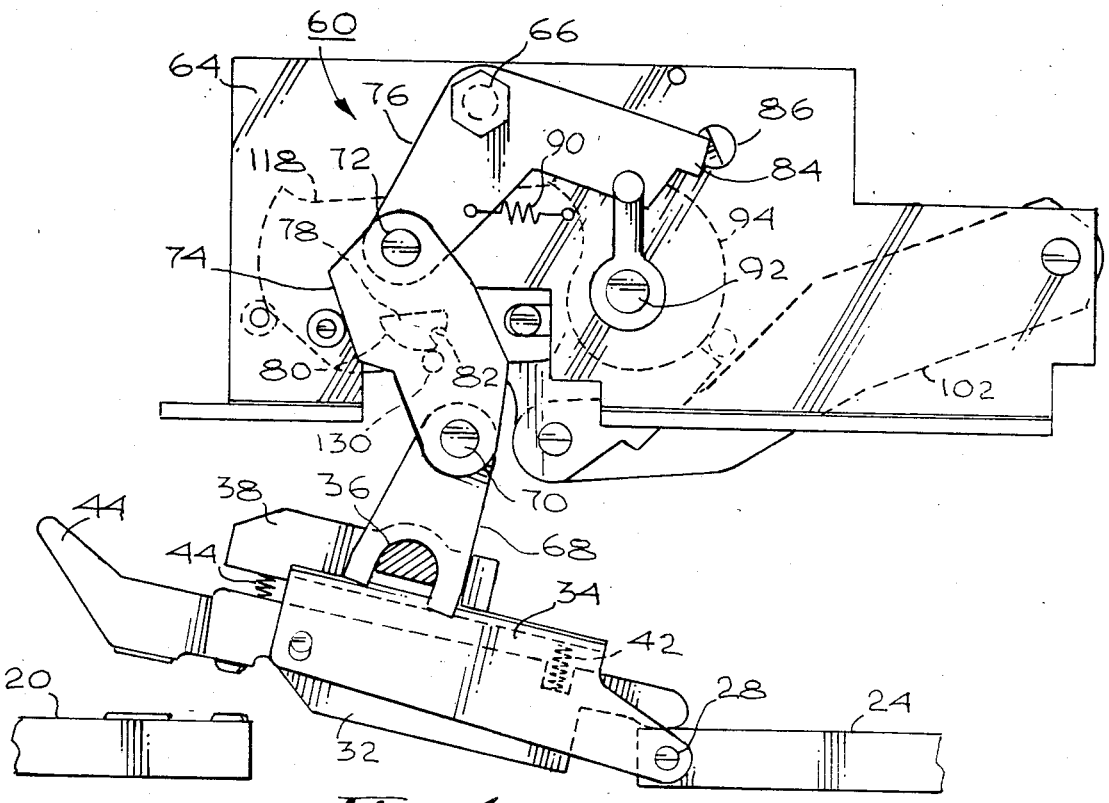
FIG. 4 is a mechanical schematic diagram of that first portion of FIG. 3 in a second condition.

The circuit-breaking operation is as follows. As the pin 86 is turned clockwise, the toggle lever 76 is allowed to turn clockwise to move the second toggle link 74 upwardly between the drive pin 130 and the roller stop 88. The first toggle link 68 and the second toggle link 74 are folded to collapse the toggle mechanism 60, therby opening the main contact device 12. FIG. 4 shows main contact device 12 being opened. At the same time that the opening of the main contact device 12 is completed, the toggle lever 76 is turned counterclockwise under the force of the tension spring 90 to allow the finger 84 to be engaged by the pin 86 again. For closing the main contact device 12 again, the actuating handle 96 of the drive mechanism 62 is turned clockwise to store energy in the closing spring assembly 102 as shown in FIG. 5. More specifically, as the actuating handle 96 is turned, the drive pin 130 slides on the convex surface 80 of the bearing plate 78 into engagement with the concave surface 82 through the combined action of the cam 94, the roller shaft 122, the cam follower 118, and the drive plates 126. When the actuating handle 96 of the drive mechanism 62 is rotated from the closing-completed position (FIG. 3), it is possible to store energy in the drive mechanism 62 while keeping the toggle mechanism 60 in the upstanding position, that is, keeping the main contact device 12 closed. Thereafter, by turning the pin 86 clockwise from the foregoing condition, the toggle mechanism 60 is transformed into a circuit-breaking condition, and by turning the shaft 140 clockwise, immediately after the circuit has been broken, the toggle mechanism 60 can be brought into the closed condition again. Thus, each of the closing and breaking steps can be performed instantaneously, without first having to effect mechanical energy storage.

The circuit breaker according to this invention exhibits several features which constitute improvements over prior art devices. As a first improvement, since the closing spring assemblies 102 are disposed between the transmission links 100 (which are pivotally supported on the actuator shaft 92) and the side plates 64 and extend substantially parallel to the movable contact assembly 26 while being controlled remotely therefrom, the movable contact assembly 26 and the actuator portion 14 can easily be spaced from each other so that no problems arise in actuator portion 14 as a result of arcs generated upon breaking the power circuit. This improvement increases the reliability of the circuit breaker and makes the actuator device small in size. A second improvement resides in the fact that the transmission links 100 are rotatable through an arc less than 180° between the energy-storing and the energy-releasing conditions, so that power can be supplied to the load terminals within a space interval in which the length of the closing spring assemblies 102 varies only slightly. Thus, the efficiency of the breaker is increased and the burden on the actuator device 14 is reduced. Furthermore, the number of parts is reduced and the construction is simpler because the actuator shaft 92 is used as the pivot shaft for the transmission links 100. As a third improvement, energy can be stored in the closing spring assemblies 102 by the rotation of the cam followers 118 in response to a single revolution of the cams 94. Therefore, energy storage in the closing spring assemblies 102 can be achieved easily and with a small force. A fourth improvement is that since the pivot of the second toggle link 74 and toggle lever 76 and the pivot of the cam follower 118 are aligned with each other at the time the toggle mechanism 60 is in the upstanding position, no slippage occurs in transmitting forces and efficiency is kept high. According to a fifth improvement, the angularly movable drive pin 130 allows the toggle mechanism 60 to collapse smoothly when breaking the circuit, with the result that any operating delay is minimal. The engagement of the drive pin 130 with the bearing plate 78 is not confined to a single point, and hence no localized damage will result even when the surface pressure is increased between the drive pin 130 and the bearing plate 78.

Figure 9:
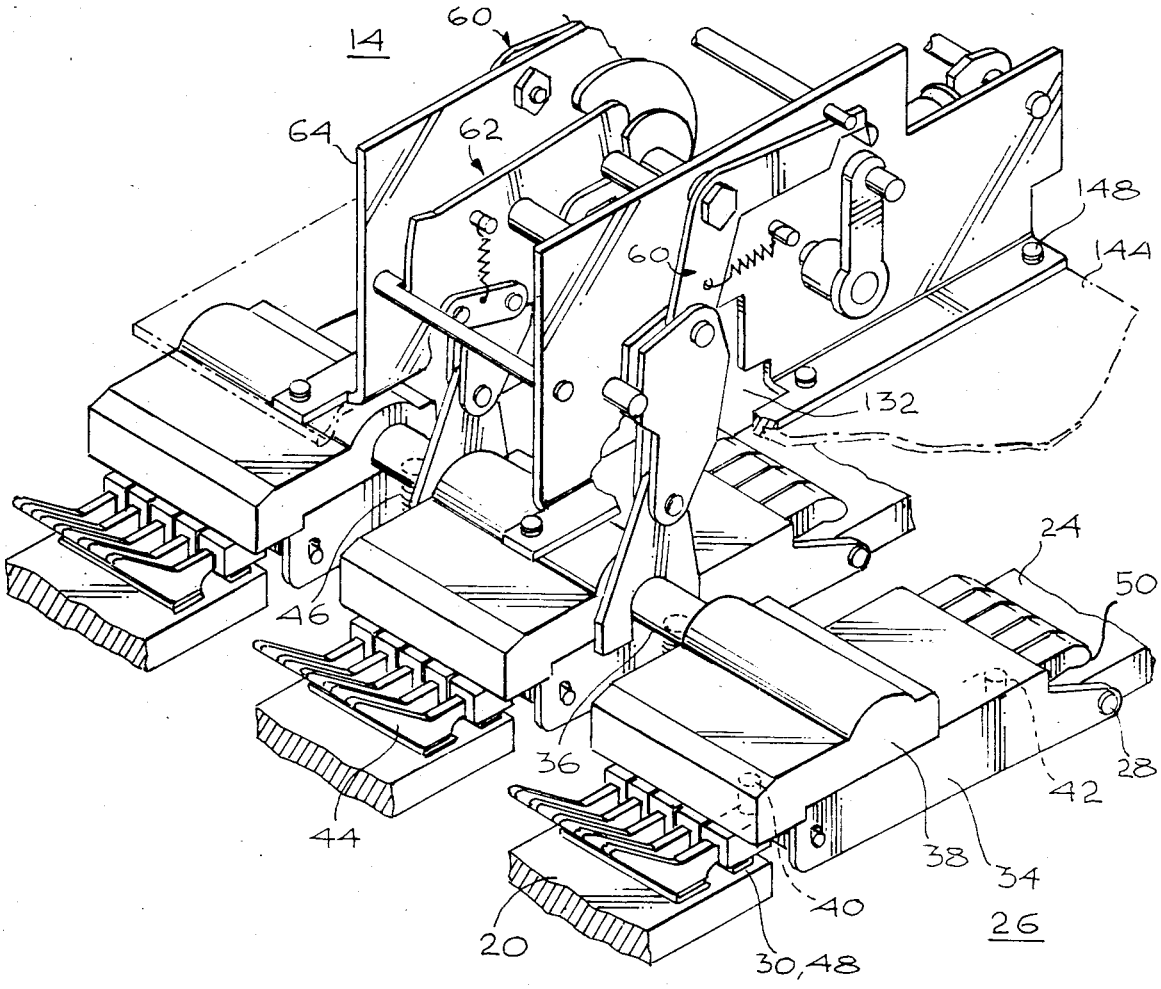
FIG. 9 is an exploded view of the device of FIG. 1.
Figure 10:
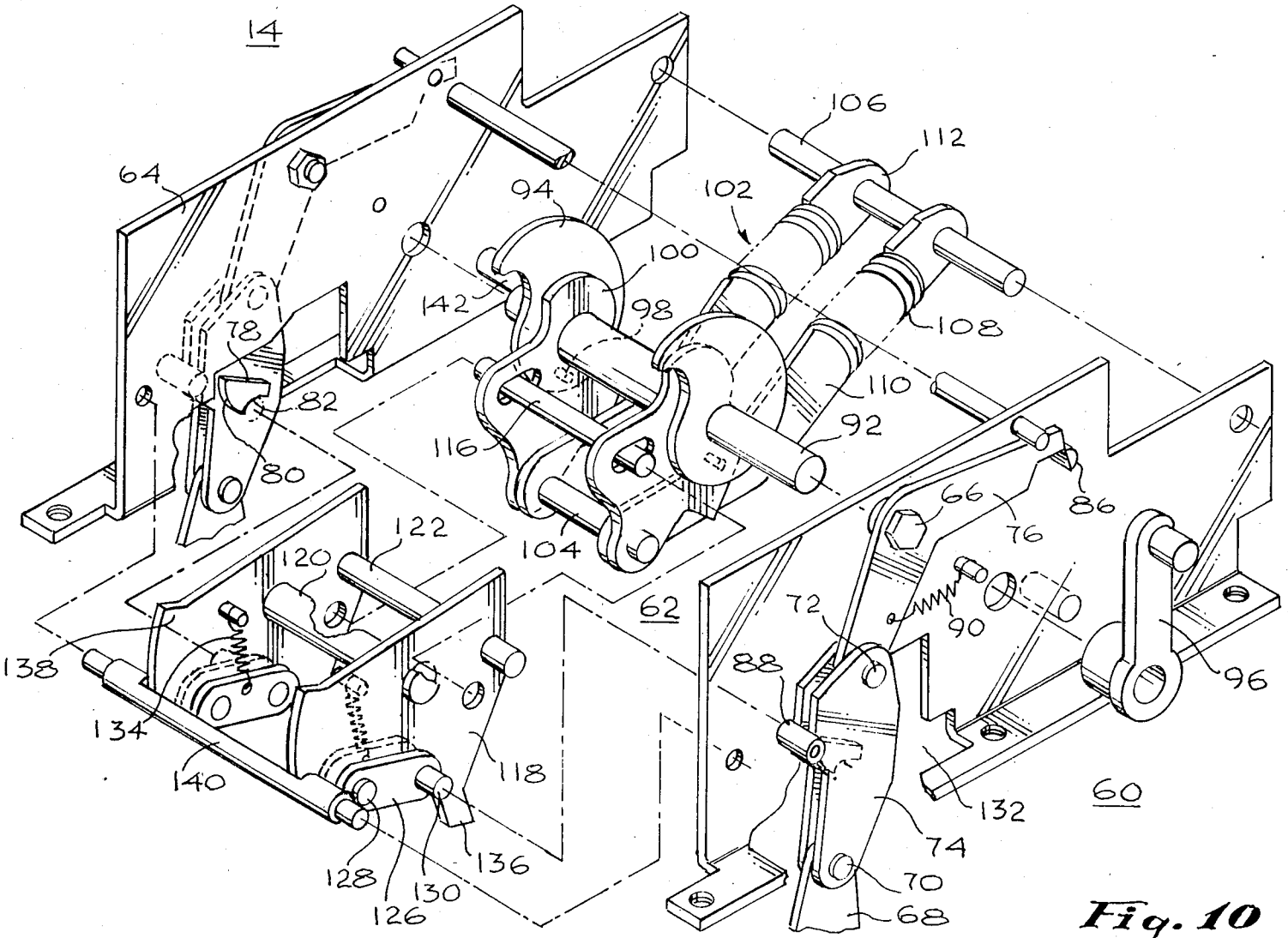
FIG. 10 is an exploded view of the actuator portion of the device of FIG. 1.

The foregoing discussion may be enchanced by referring to the exploded views of FIGS. 9 and 10.

While a particular embodiment of my invention has been shown and described, it will be apparent to those skilled in the art that modifications and variations may be made therein without departing from the spirit and scope of my invention. It is the intention of the appended claims to cover all such modifications and variations.

I claim:

1. A circuit breaker including;

an actuator portion and a main contact portion spaced from said actuator portion but mechanically coupled thereto for actuation thereby;

a partition separating said main contact portion from said actuator portion;

a pair of parallel side plates supported from said partition and normal thereto;

said main contact portion including a fixed-contact member and a movable-contact assembly, said movable-contact assembly having an axis of rotation and being positioned for movement into and out of contact with said fixed-contact member;

said axis of rotation of said movable-contact assembly being normal to the direction of said parallel side plates;

said actuator portion being supported in said side plates and including a toggle mechanism and means for driving said toggle mechanism;

said toggle mechanism including a first toggle link having a first end and a second end, said first end thereof being connected to said movable-contact assembly and being sized and positioned to move such movable-contact assembly into and out of a closed position with respect to said fixed-contact member; a second toggle link having first and second ends, said first end of said second toggle link being connected to said second end of said first toggle link, said second toggle link having a bearing plate integral therewith; and, a toggle lever having first and second ends;

a toggle-lever-pivot pivotably connecting said first end of said toggle lever to said second end of said second toggle link, said toggle lever being centrally and pivotably supported from at least one of said side plates and having a finger on said second end;

spring means coupled between said toggle lever and one of said side walls for urging said toggle mechanism into an extended condition, and positioned to releasably engage said finger on said toggle lever in said extended condition of said toggle mechanism;

said means for driving said toggle mechanism including an actuator shaft rotatably supported in said side plates at right angles thereto, a cam secured to said shaft between said side plates at right angles to said shaft, a transmission link pivotably supported on said actuator shaft at right angles thereto and between said side plates, a closing spring assembly coupled between one of said side plates and said transmission link, a cam follower, a cam-follower-pivot pivotably supporting said cam follower from one of said side plates in parallel relationship thereto, said cam follower being mechanically coupled to said transmission link, means for urging said cam follower into engagement with said cam, whereby upon clockwise rotation of said actuator shaft said cam follower rotates counterclockwise, and a drive plate pivotably mounted on said cam follower and having an engagement portion;

means for urging said engagement portion of said drive plate into cooperative engagement with said bearing plate on said second toggle link; and said cam follower including a prong for engaging a control shaft, said control shaft being pivotably mounted in one of said side plates and having a D-shaped-cross-sectioned end positioned to engage and lock said prong on said cam follower when said closing spring assembly is in an energy-stored state.

2. Apparatus according to claim 1 in which rotation of said actuator shaft thru an angle of 180 degrees produces rotation of said cam follower through an angle of less than 180 degrees.

3. Apparatus according to claim 1 in which said cam carries on one side thereof a projection, said projection being positioned to engage and restrain said cam follower when storage of energy in said closing spring assembly has been completed.

4. Apparatus according to claim 1 in which said bearing plate of said second toggle link has a concave engagement portion and said engagement portion of said drive plate is circular in cross section.

5. Apparatus according to claim 1 in which said toggle-lever-pivot and said cam-follower-pivot are aligned with each other when said toggle mechanism is in the extended position.

6. Apparatus according to claim 1 in which said engagement portion of said drive plate is a pin and said drive plate comprises two portions sandwiching said cam follower.

* * * * *